US006067890A

United States Patent [19]

Thiesen et al.

[11] Patent Number: 6,067,890

[45] Date of Patent: May 30, 2000

[54] WEAPON SYSTEM

[75] Inventors: Stefan Thiesen, Willich; Helmut Ortmann, Duisburg; Jürgen Böcker, Oberhausen; Dieter Jungbluth, Herschbach, all of Germany

[73] Assignee: Rheinmetall W & M GmbH, Unterlüss, Germany

[21] Appl. No.: 09/061,267

[22] Filed: Apr. 17, 1998

[30] Foreign Application Priority Data

Apr. 18, 1997 [DE] Germany ..... 197 16 198

[51] Int. Cl.[7] ..... F41G 3/08

[52] U.S. Cl. ..... 89/41.03; 89/41.05

[58] Field of Search ..... 89/41.03, 41.05

[56] References Cited

U.S. PATENT DOCUMENTS

| | | | |
|---|---|---|---|
| 3,538,318 | 11/1970 | Clutterbuck et al. | 702/34 |
| 3,720,131 | 3/1973 | Frohock, Jr. et al. | 89/41.03 |
| 3,733,465 | 5/1973 | Marasco | 325/153 |
| 4,020,739 | 5/1977 | Piotroski et al. | 89/41.03 |
| 4,142,799 | 3/1979 | Barton | 356/153 |
| 4,348,939 | 9/1982 | Hipp | 89/41.03 |
| 4,383,474 | 5/1983 | Paurus et al. | 89/41.03 |
| 4,665,795 | 5/1987 | Carbonneau et al. | 89/41.03 |
| 4,939,353 | 7/1990 | Iijima . | |
| 4,974,193 | 11/1990 | Beutelspacher et al. | 364/900 |
| 5,413,029 | 5/1995 | Gent et al. | 89/41.03 |
| 5,520,085 | 5/1996 | Ng et al. | 89/41.03 |
| 5,520,275 | 5/1996 | Foglino | 194/217 |

FOREIGN PATENT DOCUMENTS

| | | | |
|---|---|---|---|
| 0600170 | 6/1994 | European Pat. Off. . | |
| 3 409 538 | 8/1985 | Germany | 89/41.03 |
| 3802894 | 8/1989 | Germany . | |
| 4218 118 | 12/1993 | Germany . | |
| 2 094 950 | 9/1982 | United Kingdom | 89/41.03 |

*Primary Examiner*—Charles T. Jordan
*Assistant Examiner*—Jeffrey Howell
*Attorney, Agent, or Firm*—Venable; George H. Spencer; Norman N. Kunitz

[57] ABSTRACT

A weapon system (1) having a weapon (2) with a weapon tube (3) and having an electronic system (4) for generating aiming signals for an aiming system (7) connected to the weapon (2). To ensure that the current weapon properties or tube properties are also considered in a simple manner for the determination of the aiming signals, the respective weapon-specific data are stored on a chip card (13) associated with the weapon (2) and are transferred via a chip card reader (11) to the corresponding electronic system (4) required for the determination of the aiming signals. During this process, the weapon-specific data are updated on the chip card at predetermined time intervals.

8 Claims, 1 Drawing Sheet

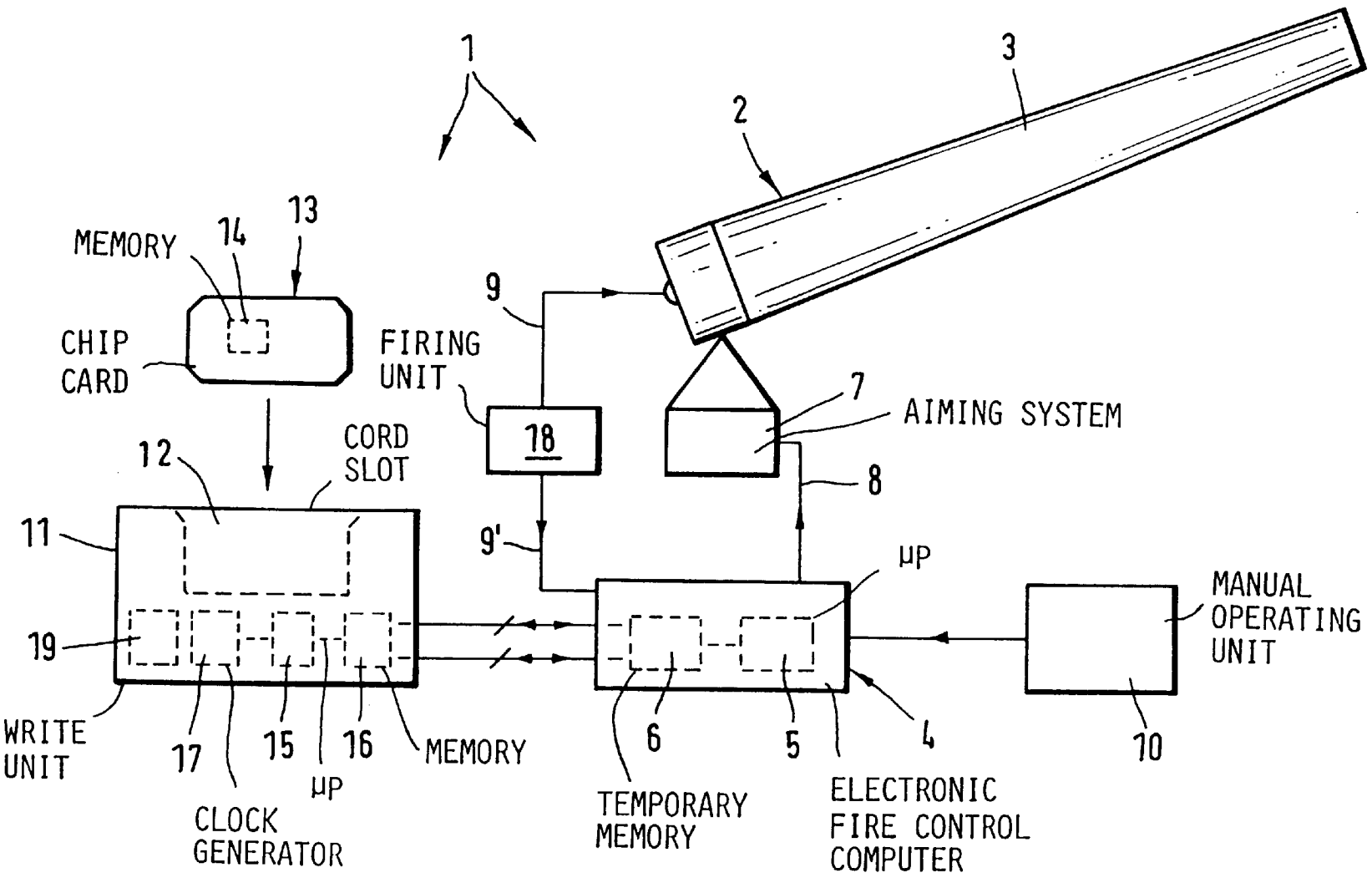
MANUAL OPERATING UNIT
10
AIMING SYSTEM
3
7
8
µP
4
ELECTRONIC FIRE CONTROL COMPUTER
2
5
6
TEMPORARY MEMORY
1
9
18
9'
FIRING UNIT
MEMORY
CORD SLOT
16
13
µP
15
14
CLOCK GENERATOR
MEMORY
CHIP CARD
12
17
11
19
WRITE UNIT

WEAPON SYSTEM

REFERENCE TO RELATED APPLICATIONS

This application claims the priority of German application Serial No. 197 16 198.7, filed Apr. 18, 1997, which is incorporated herein by reference.

BACKGROUND OF THE INVENTION

The invention relates to a weapon system having a weapon with a weapon tube and having an electronic system for generating aiming signals for an aiming system connected to the weapon.

Whether a projectile fired by a weapon system, e. g., by a battle tank, actually hits a target, depends on a number of different influencing quantities. In particular, the individual shape of the curvature of the bore axis is an important influencing quantity. Additionally, the properties of the tube of the respective weapon, which properties change over time, e.g., because of wear or the change of the curvature, can have a relatively large influence on the trajectory of the respective projectile.

As far as Applicant is aware, such tube properties and/or their changes have so far not been considered for the determination of the aiming signals.

It is the object of the present invention to provide a weapon system wherein the respectively current weapon properties or tube properties of the weapon tube are considered in a simple manner for the determination of the aiming signals so as to optimize the hit-at-first-strike probability of the weapon system (e. g., of each battle tank of a battle tank fleet).

SUMMARY OF THE INVENTION

The above object generally is achieved according to the invention by a weapon system including: a weapon having a weapon tube; an electronic system for generation of aiming signals for an aiming system that is connected to the weapon; a chip card reader connected to the electronic system as well as a chip card with a memory, which chip card can be inserted into a corresponding card slot of the reader, is associated with the respective weapon, and has weapon-specific data of the corresponding weapon system stored in its memory; and wherein the chip card reader includes a memory and a processor for, after insertion of the chip card into the slot of the reader), reading the weapon-specific data stored in the chip card memory and for storing the readout data in the memory of the card reader for retrieval by the electronic system. Further advantageous refinements of the invention are disclosed and described.

Substantially, the invention is based on the concept of storing the weapon-specific data on a chip card associated with the respective weapon and transferring the data via a chip card reader to the corresponding electronic system (usually the fire control computer) required for the determination of the aiming signals. During this process, the weapon-specific data are updated on the chip card at predetermined intervals.

In an advantageous embodiment of the invention, the respectively current weapon-specific data, e. g., the wear of the weapon tube, etc., are determined either by the fire control computer or by the chip card reader in conjunction with the fire control computer (e. g., from the number of firings, the tube temperature, etc.) and are transferred to the chip card after each firing or after a firing sequence via the chip card reader, which also comprises a write unit. In these cases, a separate updating of the data of the respective chip card can be omitted. Moreover, the current tube properties are available for the determination of the aiming signals prior to each firing, so that, in a simple manner, the combat power can be enhanced considerably.

A further advantage of the weapon system according to the invention is that a manipulation of the weapon system by unauthorized third parties is prevented in a simple manner. That is, the weapon can be activated only if the specific chip card reader identifies the chip card associated with the respective weapon system and the corresponding weapon-specific data are transferred to the fire control computer. As a rule, the chip card (commander or master chip card) should therefore be administered only by the respective commander of the weapon system (or of the battle tank), so that a secure use for the intended purpose of the corresponding weapon system is ensured.

Further details and advantages of the invention ensue from the embodiment below which is explained by way of a FIGURE.

BRIEF DESCRIPTION OF THE DRAWINGS

The FIGURE is a schematic block diagram of a weapon system according to the invention.

DETAILED DESCRIPTION OF THE PREFERRED EMBODIMENT

In the FIGURE, reference numeral 1 identifies a schematically illustrated weapon system of a battle tank. This weapon system is essentially comprised of a weapon 2 having a weapon tube 3 and a fire control computer 4 with a microprocessor 5 and a temporary memory or store 6 for the generation of aiming signals for an aiming system 7 connected with the weapon 2. A first output of the fire control computer 4 is therefore connected with the aiming system 7 via a line 8.

For entering target-relevant data into the fire control computer 4, an operating unit 10, which can be operated by the gunner or the commander of the tank, is also provided.

According to the invention, a chip card reader 11 is connected upstream of the fire control computer 4. A chip card 13, with a memory 14 having data associated with a specific weapon 2, can be inserted into the slot 12 of the chip card reader. The reader 11 comprises an electronic circuit arrangement, not shown in detail for reasons of clarity, for the reading and optionally overwriting of the weapon-specific data stored in the memory 14 of the chip card 13, as well as a microprocessor 15 and a memory 16. Furthermore, the chip card reader 11 has a clock or timing generator 17 whose function will be explained further below in greater detail.

Preferably, the data saved in the memory 14 of the chip card 13, in addition to data which identify a specific weapon 2, are data which relate to the tube statics (e. g., the curvature of the tube axis), the wear condition, as well as the total number of firings of the corresponding weapon tube of the specific weapon.

The following application details the operating mode of the weapon system according to the invention:

Once the battle tank including the fire control computer 4 as well as the peripheral equipment has been put into operation, the commander of the tank places the chip card 13 into the slot 12 of the chip card reader 11. Only from this moment on can the weapon be activated for use. The reader 11 reads the data stored in the memory 14 of the card 13, evaluates the data, for example to determine if the inserted and read card 13 is for the specific weapon 2 connected to the card reader 11, and then stores the read out data in the memory 16. The data stored in the memory 16 are retrieved by the fire control computer 4 for the determination of aiming signals. The comparison to determine if the associated card 13 is in the card reader may be carried out by the fire control computer 4, if desired. In any case, if the proper card 13 is identified, the weapon 2 can be activated by the fire control system.

After the input of corresponding target-specific data, e.g., target distance, via the operating unit 10, the fire control computer 4 calculates the aiming signals (according to elevation and azimuth) and forwards these signals to the aiming system 7 via the line 8.

If the commander now gives the firing command, e. g., via a firing unit 18, the corresponding firing pulse is supplied, if the coincidence condition between the identification on the card 13 and the weapon 2 has been met, to the breechblock of the weapon 2 via the line 9 and the corresponding ammunition unit is fired. At the same time, the fire control computer 4 is informed of the firing by means of a line 9', causing the computer 4 to update the data on the chip card 13 (e. g., total number of firings of the tube, firing frequency) by means of a write unit 19.

With the assistance of the clock generator 17 arranged in the chip card reader 11, the data are again read out of the memory 14 of the chip card 13 at predetermined time intervals, are evaluated in the reader 11 and transmitted to the fire control computer 4 in updated form. Thus, it is ensured that the fire control computer 4 always receives the current data from the chip card 13.

Of course, the invention is not limited to the above-described embodiment. This means that, for example, the data preparation for the data to be transferred to the memory 14 of the chip card 13 after a firing can also be carried out by a write unit in the fire control computer instead of by the chip card reader 11. Moreover, an external clock generator or the clock generator, which is present in the fire control computer anyhow, can be used as a clock generator for reading out the data currently saved on the chip card 13.

The invention now being fully described, it will be apparent to one of ordinary skill in the art that many changes and modifications can be made thereto without departing from the spirit or scope of the invention as set forth herein.

What is claimed:

1. A weapon system including: a weapon having a weapon tube; an electronic system for generating of aiming signals for an aiming system that is connected to the weapon; a chip card reader connected to the electronic system; a chip card with a memory, which chip card can be inserted into a corresponding card slot of the reader, is associated with a specific weapon, and has weapon-specific data needed for operation of the specific corresponding weapon system stored in its memory; and wherein the chip card reader includes a memory and a processor for, after insertion of the chip card into the slot of the reader, reading the weapon-specific data stored in the chip card memory and for storing the readout data in the memory of the card reader for retrieval by the electronic system.

2. A weapon system according to claim 1, wherein the weapon-specific data stored in the memory of the chip card includes tube statics, including the curvature of the tube axis, the wear condition of the tube, and the total number of firings of the specific weapon tube.

3. A weapon system according to claim 2, wherein after each firing, the processor fo the chip card reader determines the current weapon-specific data, including the number of firings, and the tube wear, from the data transmitted by the electronic system and transfers this transmitted data to the chip card memory via a write unit of the card reader.

4. A weapon system according to claim 1, wherein the electronic system comprises a temporary memory and a processor for, after each firing, determining current weapon-specific data, including a number of firings and tube wear, and storing this data in the temporary memory of the electronic system for retrieval by the processor of the chip card reader and transferral to the chip card memory.

5. A weapon system according to claim 1, further comprising a clock generator for, at predetermined time intervals, causing the current data stored in the memory of the chip card to be read out and transferred to the electronic system in updated form.

6. A weapon system according to claim 5, wherein the electronic system is a fire control computer.

7. A weapon system according to claim 1, further comprising circuit means for permitting activation of the weapon only when the chip card specific to the respective weapon system is disposed in the slot of the chip card reader.

8. A weapon system according to claim 1, wherein the electronic system is a fire control computer.

* * * * *